United States Patent [19]

Dubois

[11] 4,175,599

[45] Nov. 27, 1979

[54] BALSAWOOD STRIPPER

[76] Inventor: Eugene Dubois, P.O. Box C, Acushnet, Mass. 02743

[21] Appl. No.: 842,742

[22] Filed: Apr. 11, 1978

[51] Int. Cl.[2] ..... B27C 1/14; B27L 7/00

[52] U.S. Cl. ..... 144/175; 30/289; 83/425; 83/440; 83/856; 144/120; 144/155; 144/193 C; 144/184

[58] Field of Search ..... 144/162 R, 193 R, 193 C, 144/175, 321, 323, 120, 155, 184, 186; 30/289, 290, 294, 124, 304; 83/431, 425, 440, 856, 870; 145/8, 10

[56] References Cited

U.S. PATENT DOCUMENTS

| | | | |
|---|---|---|---|
| 2,204,763 | 6/1940 | Maximilian | 30/289 |
| 2,247,840 | 7/1941 | Harrison | 30/289 |
| 2,388,695 | 11/1945 | Kriewaldt | 30/289 |
| 2,423,807 | 7/1947 | Zindrick | 144/175 |
| 2,456,436 | 12/1948 | Metzger | 30/294 |
| 3,783,917 | 1/1974 | Mochizuki | 144/175 |
| 4,100,676 | 7/1978 | Ferguson | 269/295 |

*Primary Examiner*—Robert Louis Spruill
*Assistant Examiner*—W. D. Bray
*Attorney, Agent, or Firm*—Barlow & Barlow

[57] ABSTRACT

A strip cutting device for wood or the like having a plurality of parallel slots of different depths with a cutter disposed above the slots and means for holding the cutter across a plurality of the slots and at an angle to said slots and intermediate the ends of the slots so that work slid along a selected slot will be severed by the cutter and the work will be guided both in its approach to the cutter and after it has passed the cutter for discharge. There will be holding means for the cutter on either side of each of the slots and also on either side of the cutter to maintain the cutter fixedly in place.

7 Claims, 3 Drawing Figures

BALSAWOOD STRIPPER

BACKGROUND OF THE INVENTION

In devices for cutting strips, such as wood or the like, there has been trough-shaped guides with adjustable cutters at the end of the trough for the varying of the thickness of the strip to be cut by sliding along the trough. Adjustments of this sort because of their complexity are expensive to construct and use so far as varying depths are concerned and the guide is often insecure because of the single trough such as depicted in U.S. Pat. No. 2,423,807.

SUMMARY OF THE INVENTION

The present invention resorts to providing slots of different depths in a base to avoid any adjustment of the cutter and places the cutter across the face of the base in which the plurality of slots of varying depth are provided enabling it to be secured by a guide on either side of the slot and on either side of the cutter by removable clamping means, thus enabling the cutter to be removed for sharpening or replacement if desired. The cutter is also placed intermediate the ends of the slots so that the work is guided on its approach to the cutter as well as its leaving the cutter.

DESCRIPTION OF THE PREFERRED EMBODIMENT

Figure 1:
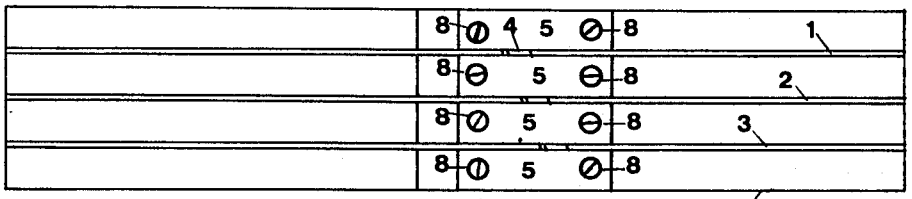
FIG. 1 is a top plan view of the strip cutting device.
Figure 2:
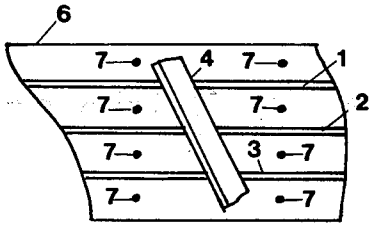
FIG. 2 is a fragmental view with the cutter holding means removed and exposing the cutter.
Figure 3:
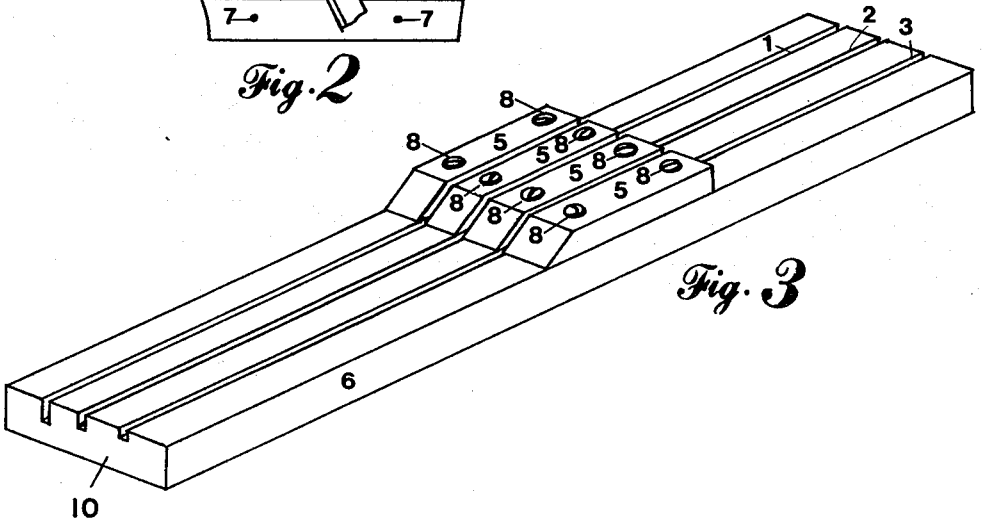
FIG. 3 is a perspective view showing the cutter holding means and the base of the slots therein in assembled position.

A base designated 6 is formed of any suitable material which will not warp, in many instances laminated hard wood, which has a face 10. There are located slots 1, 2 and 3 in the face 10, each of a different depth. Thus, as seen at the end of the base 6, the slot 1 is deepest, the slot 3 is shallowest and the slot 2 is of a depth intermediate the two. This arrangement may be carried out to a greater extent with more slots as desired. Upon the face 10 of the base a cutter 4 is disposed which extends across all of the slots and is at an angle to the parallel arrangement of the slots. The cutter may be double-edge razor blade. In order to hold this cutter 4 in place, strips 5 located against the face and on either side of each of the slots and on either side of the blade 4 are screwed in place as a holding means for the cutter by pair of head screws 8 entering holes 7 in the face of the base, thus enabling this holding means to be removed to remove the cutter for sharpening or replacement. By the spacing of the strips 5, four of which are shown, a flat thin piece of work substantially the thickness of the width of a slot, such as balsa wood, may be slid in a selected one of these slots being manually pushed along the slot and a strip of the desired depth may be cut therefrom. The work is guided to and from the cutter by the side walls of the slot and also by the cutter holding strips 5.

In use, one of the slots such as 3 may be 1/16" deep; slot 2 may be 3/32" deep and slot 1 may be ⅛" deep. This may be carried on indefinitely and by sliding the plate of balsa wood through one of these selected slots, the strip will be in one dimension the thickness of the balsa plate and in another dimension to the depth of the slot. If it is desired to have some different dimension, it might be that one of the strips which is first cut will be passed through another one of the slots or another strip formed by passing the plate of balsa wood or other work along the slot with the strip therein to make the strip a dimension minus the thickness of the strip deposited in the slot. Cut strips may be cemented together.

By arranging the knife intermediate the ends of the slot, the plate and its strip as it is passed through the slot is guided both before and after the severing occurs.

I claim:

1. A strip cutting device comprising a base having a face with a plurality of substantially parallel slots in said face for guiding work therealong, said slots being of different depth, a cutter disposed over said slots intermediate the ends of the slots for cutting work slid along a selected slot, means detachably mounted on said base for holding said cutter in place, said slots extending on either side of the cutter for guiding the work to and from the cutter.

2. A strip cutting device as in claim 1 wherein the base is elongated and the slots extend longitudinally thereof.

3. A strip cutting device as in claim 1 wherein the means for holding the cutter is on either side of each of the slots.

4. A strip cutting device as in claim 1 wherein the means for holding the cutter is on either side of the cutter.

5. A strip cutting device as in claim 1 wherein the means for holding the cutter is on either side of each of the slots and is on either side of the cutter.

6. A strip cutting device as in claim 1 wherein the cutting edge of the cutter is at an angle to said slots.

7. A strip cutting device as in claim 1 wherein the base is of laminated wood.

* * * * *